US008987487B2

(12) United States Patent
Sohling et al.

(10) Patent No.: US 8,987,487 B2
(45) Date of Patent: Mar. 24, 2015

(54) METHOD FOR REMOVING PHOSPHORUS-CONTAINING COMPOUNDS FROM TRIGLYCERIDE-CONTAINING COMPOSITIONS

(75) Inventors: Ulrich Sohling, Freising (DE); Friedrich Ruf, Tiefenbach-Ast (DE); Andrea Stege, Moosburg (DE)

(73) Assignee: Süd—Chemie IP GmbH & Co. KG, München (DE)

( * ) Notice: Subject to any disclaimer, the term of this patent is extended or adjusted under 35 U.S.C. 154(b) by 32 days.

(21) Appl. No.: 13/879,168

(22) PCT Filed: Oct. 13, 2011

(86) PCT No.: PCT/EP2011/067852
§ 371 (c)(1),
(2), (4) Date: Sep. 25, 2013

(87) PCT Pub. No.: WO2012/049232
PCT Pub. Date: Apr. 19, 2012

(65) Prior Publication Data

US 2014/0012025 A1 Jan. 9, 2014

(30) Foreign Application Priority Data

Oct. 13, 2010 (DE) ..... 10 2010 048 367

(51) Int. Cl.
*C11B 3/00* (2006.01)
*C11B 3/10* (2006.01)
*C11B 3/04* (2006.01)

(52) U.S. Cl.
CPC . *C11B 3/10* (2013.01); *C11B 3/001* (2013.01); *C11B 3/006* (2013.01); *C11B 3/04* (2013.01)
USPC ..... 554/185; 554/190; 554/191; 554/204

(58) Field of Classification Search
USPC ..... 554/185, 190, 191, 204
See application file for complete search history.

(56) References Cited

U.S. PATENT DOCUMENTS

| | | | | |
|---|---|---|---|---|
| 4,623,489 | A * | 11/1986 | Rivers, Jr. | 554/175 |
| 5,045,519 | A | 9/1991 | Meyer | |
| 5,069,829 | A * | 12/1991 | Van Dalen et al. | 554/191 |
| 5,231,201 | A * | 7/1993 | Welsh et al. | 554/191 |
| 5,239,096 | A * | 8/1993 | Rohdenburg et al. | 554/176 |
| 6,015,915 | A | 1/2000 | Jamil | |
| 6,245,310 | B1 | 6/2001 | Brasch | |
| 6,346,286 | B1 | 2/2002 | Council | |

(Continued)

FOREIGN PATENT DOCUMENTS

| | | |
|---|---|---|
| AU | 1998 83267 | 7/1998 |
| CA | 1157883 | 11/1983 |

(Continued)

OTHER PUBLICATIONS

Oybek Zufarov et al: "Ethanolamines used for degumming of rapeseed and sunflower oils as diesel fuels ", European Journal of Lipid Science and Technology, vol. 111, No. 10, 2009, pp. 985-992.*

(Continued)

*Primary Examiner* — Deborah D Carr
(74) *Attorney, Agent, or Firm* — Hueschen and Sage

(57) ABSTRACT

The present invention relates to a method for removing phosphorus-containing compounds from triglyceride-containing compositions.

13 Claims, 2 Drawing Sheets

(56) References Cited

U.S. PATENT DOCUMENTS

Figure 1:
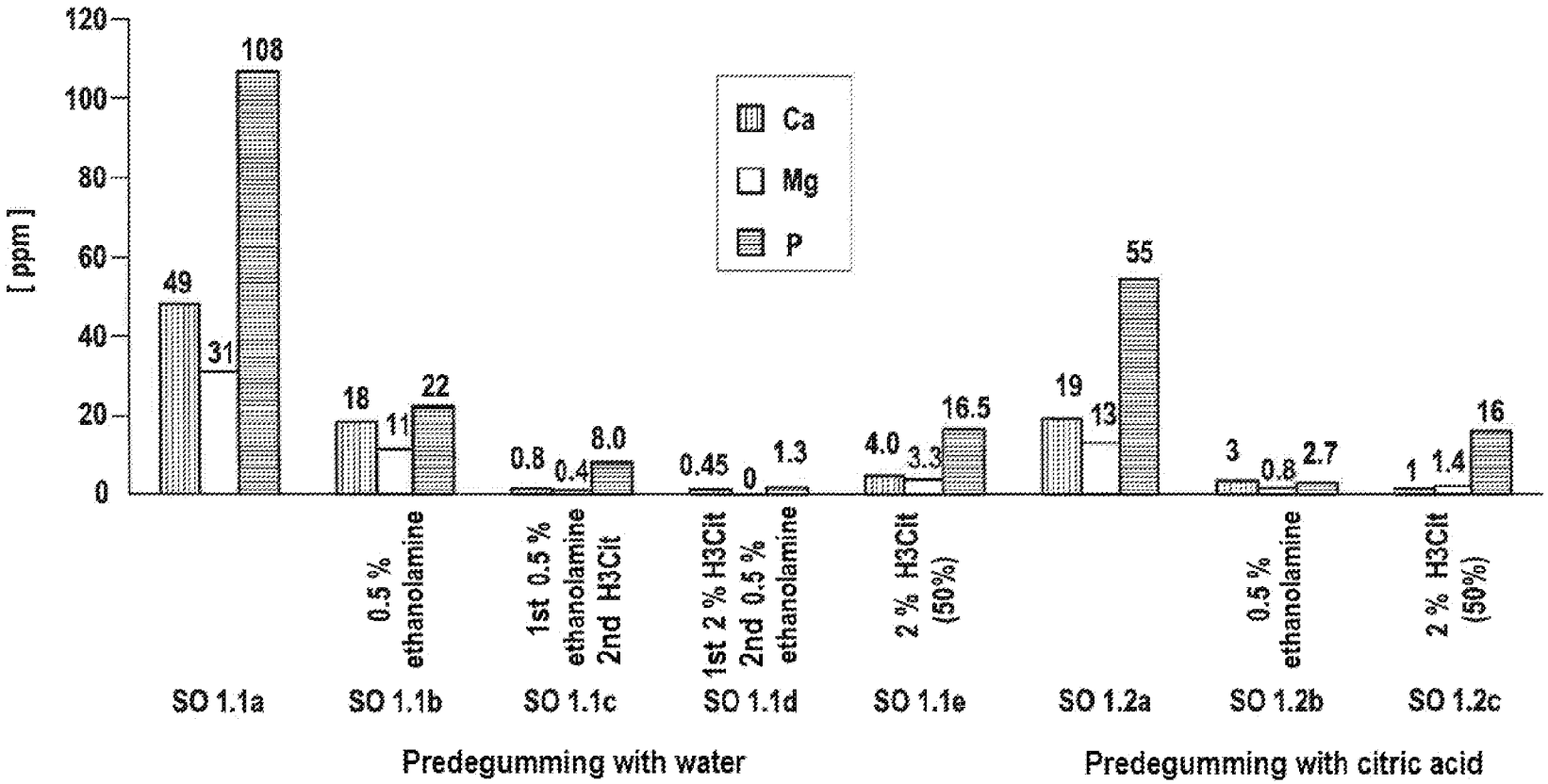

| | | | |
|---|---|---|---|
| 2002/0098142 | A1 | 7/2002 | Brasch |
| 2006/0096159 | A1 | 5/2006 | Bonsch |
| 2008/0223756 | A1 | 9/2008 | Schurz |
| 2009/0306419 | A1 | 12/2009 | Myong |

FOREIGN PATENT DOCUMENTS

| | | | | | |
|---|---|---|---|---|---|
| CA | 2351338 | | | 6/2000 | |
| CA | 2434499 | | | 6/2000 | |
| DE | 284043 | | | 10/1990 | |
| EP | 0269277 | | | 10/1987 | |
| EP | 2053118 | | | 9/2008 | |
| GB | 391658 | | | 5/1933 | |
| GB | 1541017 | | | 3/1975 | |
| GB | 1510056 | | | 3/1976 | |
| GB | 2458709 | | | 9/2009 | |
| GB | 2458709 | A | * | 9/2009 | ..... C11B 3/16 |
| SU | 1731793 | | | 5/1992 | |
| WO | WO 96/33621 | | | 10/1996 | |
| WO | WO 2007/098928 | | | 9/2007 | |
| WO | WO 2007098928 | A1 | * | 9/2007 | ..... C11C 3/00 |
| WO | WO 2009/068274 | | | 6/2009 | |

OTHER PUBLICATIONS

20306 Removal of Phosphatides (NHP) From Vegtable Oils, Research Disclosure, Mar. 1981, p. 110-111.

Barrett, J. Am. Chem. Soc., vol. 736, p. 373-380, Jan. 1951.

Belitz, "Lehrbuch Der Lebensmittelchemie" p. 151-181, 2001.

Gupta, AOCS PPRESS, Practical Guide to Vegetable Oil Processing, Chapter 5, p. 101, 2008.

Gupta, AOCS PPRESS, Practical Guide to Vegtable Oil Processing, Chapter 3, p. 33, 2008.

Hvolby, Journal of The American Oil Chemists Society, vol. 48, p. 503-509, Sep. 1970.

International Search Report of Jan. 10, 2012 for PCT/EP2011/067852.

Zschau, "Was Ist Bleicherde?" Fette Seifen Anstrichmittel, p. 506, 1985.

Zschau, Eur Journal Lipid SCI. Technol. vol. 102, p. 505-508, 2001.

Zschau, Eur Journal Lipid Sci. Technol. vol. 103, p. 509-513, 2001.

Zufarov, et al., European Journal of Lipid Science and Technology, vol. 111, No. 10, p. 985-992, Oct. 1, 2009.

* cited by examiner

METHOD FOR REMOVING PHOSPHORUS-CONTAINING COMPOUNDS FROM TRIGLYCERIDE-CONTAINING COMPOSITIONS

The present invention relates to a method for removing phosphorus-containing compounds from triglyceride-containing compositions.

The desliming or degumming of vegetable oils denotes methods for removing phosphorus-containing compounds from vegetable oil. If vegetable oil is used as a foodstuff, it is expedient to reduce the phosphorus content as the shelf life is thereby improved. However, in recent years vegetable oil has also increasingly been used as a raw material for the chemical industry and for producing biodiesel. This trend accompanies dwindling supplies of petroleum and natural gas. Often even stricter specifications in respect of the final phosphorus value are required for the use of vegetable oil for producing biodiesel or other chemical raw materials. For example, the European standard limits the phosphorus content in biodiesel to 4 ppm, and it is to be assumed that in the future this value will be reduced further to 1 ppm or even less.

In a method of the state of the art for producing biofuels, vegetable oil is hydrogenated with hydrogen to form paraffin with the help of a heterogeneous catalyst. Such a method is represented for example by the so-called Nex BTL process from Neste in Finland. As phosphorus-containing compounds can poison heterogeneous catalysts, a particularly low phosphorus content in the vegetable oil must be set for this process.

In addition to the examples listed, there is a large number of further processes in which vegetable oil is used in chemical raw materials and which, due to the final specification or the use of heterogeneous catalysts, require a particularly low phosphorus content in the vegetable oil.

Hvolby [Hvolby A., JAOCS 48:503 (1971)] treated degummed soya oil with a large quantity of EDTA solution in order to remove calcium and phospholipids from the oil and facilitate a degumming (8 parts 10% EDTA solution to 1 part oil). Likewise he treated crude soya oil with the same volume ratio with a saturated sodium pyrophosphate solution and obtained a 90% removal of the non-hydratable phospholipids.

DE 10257215 B4 from Lurgi AG presents a method by which the storage properties of biodiesel can be improved. For this, i.a. a mixture of an acid and a complexing agent, such as for example EDTA, is added to the crude ester phase in an intermediate step and a fine emulsion produced at 50° C. This emulsion breaks after approx. 30 minutes and the ester phase is then washed with water. The thus-obtained, purified biodiesel is virtually free of all condensation and crystal nuclei as well as mucilaginous substances and iron compounds.

In US 20090306419, Cargill describes a method in which a feed stream of crude vegetable oil is mixed with water under ultrahigh shear forces. Depending on the phosphorus content in the oil, a complexing carboxylic acid such as citric acid and/or phosphoric acid and/or their salts can be added to the water here. The mucilage that forms is then separated in a retention tank and the degummed oil bleached and deodorized.

In SU 1731793 A1, it is described how a 0.1-0.5% aqueous solution of hydroxyethylenediphosphonic acid, nitrilotrimethylphosphonic acid or their K salts is used as complexing agent for degumming oils pretreated with citric acid.

In WO 2009/068274 (EP 2008/010044) the company Grace GmbH & Co. KG describes the use of liquid adsorbent solutions for the additional purification of previously degummed vegetable oils or fatty acid methyl esters. Aqueous solutions of citric acid, caustic soda solution and suspensions of colloidal silicon dioxide in water are used here in succession or in mixtures as liquid adsorbents.

In WO 9633621 A1, Oil Dri Corporation America outlines a pre-purification method for vegetable oils in which a clay is co-ground with an organic acid. This mixture is used to carry out a pre-purification which is followed by a bleaching with bleaching earth.

In a published research study, Alfa-Laval AB describes with reference to RD 203006 a method in which water with a low level of a water-soluble polymeric substance is added shortly before the separation of the phospholipids after a treatment with a weak organic acid. This would significantly reduce the proportion of non-hydratable phospholipids. Here anionic, cationic and non-ionic polymers, such as e.g. starch, milk powder, casein, methyl cellulose and gum arabic, are listed as polymeric substances.

In EP 269277 B1 from the Cambrian Engineering Group Ltd. the degumming is preferably carried out at below 40° C. A weak organic acid, e.g. a 50% citric acid solution, is added to the vegetable oil, a certain quantity of water is added and degumming is carried out at below 40° C. accompanied by stirring. The precipitated mucilaginous substances are separated by means of centrifuging and the oil is subjected to a further bleaching with customary bleaching earths. Maleic acid, acetic anhydride, lactic acid and oxalic acid in aqueous saturated solution are named as further possible organic acids.

The Oilseeds Biorefinery Corporation George Town (EP 02053118 A1) describes the removal of phospholipids from fats/oils by means of enzymatic pre-treatment and subsequent washing with an aqueous solution of a complexing agent from the group of ethylenediaminetetraacetic acid, β-alaninediacetic acid, nitrilotriacetic acid, diethylenetriaminepentaacetic acid, hydroxyethylethylenediaminetriacetic acid, iminodiacetate or an aqueous solution of an acid such as citric acid, lactic acid, fumaric acid, tartaric acid or phosphoric acid or both.

In AU 728062 B2, the oil is firstly treated with an organic acid from the group citric acid, malic acid, ethylenediaminetetraacetic acid, tartaric acid, oxalic acid, maleic acid or an inorganic acid such as phosphoric acid, hydrochloric acid or sulphuric acid. After sufficient blending, an aqueous solution of a carboxylic acid with at least 3 carboxyl groups in the acid form or as salt with a monovalent ion as electrolyte or complexing agent is added, here the sodium salt of EDTA is preferably used. The non-hydratable phospholipids are hereby converted to a hydratable form and can be removed with the aqueous phase. Before separation of the oil phase, a surfactant (Na-lauryl sulphate) can be added.

A similar process is also described in CA 2164840. Here, an organic acid such as citric acid, phosphoric acid, oxalic acid, tartaric acid, aminocarboxylic acids, polyhydroxycarboxylic acids, polycarboxylic acids, their salts, their mixtures of each other as well as a surfactant of anionic, cationic, zwitterionic or non-ionic type, added or formed in situ, is used for degumming. Preferably, trisodium citrate or the sodium salt of EDTA with sodium lauryl sulphate as surfactant is also used here at 60-90° C.

The use of citric acid for degumming vegetable oils is discussed in many other publications (e.g. DE 2609705 C3, DD 284043 A5, CA 2434499 C, CA 2351338 C, GB 01510056 A, Smiles et al.), wherein the acid in aqueous solution in different concentrations comes into contact with the oil at different temperatures for different lengths of time. Nash et al. (1984) combine citric acid in high concentrations with surfactants such as oxazoline, polymeric sulphonates or alkyl sulphates or with crude lecithin, and although this leads to a reduction of the phosphorus content, the final content is still very high.

In the 1983 patent CA 1157883, United Oilseeds Products Ltd. describes the use of citric acid for degumming preferably at temperatures between 40 and 75° C.

Choukri et al. describes the use of EDTA for degumming crude oil or oil predegummed with water. Here, optimally at >65° C., 5% of an aqueous EDTA solution is added to the oil, a surfactant (sodium lauryl sulphate) is added and blended for 20 min.

O. Zufarov et al. (Eur. J. Lipid Sci. Technol. 2009, 111, 0000-0000) treats water-degummed rape-seed oil and sunflower oil at room temperature by adding ethanolamine at room temperature.

A further method in which the oil is degummed with a liquid phase has been described in WO 2009/068274 from Grace/Desmet.

Due to the increasing use of vegetable oils for producing raw materials for the chemical industry and the resulting requirements for a low phosphorus content or a low phosphorus content of these oils, there is a steadily growing demand for yet more efficient methods for removing phosphorus from crude oils. However, the methods of the state of the art show that the effect of these methods is limited. Thus in some cases, despite upstream water degumming, only a reduction to more than 10 ppm phosphorus in the oil is achieved. There is also a high dependence on the type of oil. Here, it is also to be taken into account that crude oils of the same type differ markedly in respect of the phosphorus content, depending on the plant variety, the growing conditions, the harvesting and storage conditions as well as the type of oil production.

There was therefore a demand for a method for reducing the phosphorus content in triglyceride-containing compositions, in particular crude vegetable oils, through which a very great reduction in the phosphorus content can easily be achieved and which can moreover be used on an industrial scale.

The inventors of the present application therefore set themselves the object of developing such a method which, in addition, makes possible a reduction of the phosphorus content even of crude oils with a very high phosphorus content (for example waste oils and rape oils) in a simple way, with the result that they can be used for producing biodiesel without further treatment. Furthermore, the inventors of the present application have set themselves the object of providing a method which is suitable not only for the treatment of crude vegetable oils but can also be applied to other phosphorus-containing triglyceride compositions, in particular crude biodiesel.

To achieve this object, the inventors of the present application provide a method for removing phosphorus-containing compounds from triglyceride-containing compositions, comprising the following steps:

a) bringing the triglyceride-containing composition into contact with at least one substance selected from organic acids, phosphoric acid, ethanolamine and solid adsorbents based on clay minerals, bleaching earths, aluminosilicates or silicates;
b) adding H2O to the composition according to step a);
c) separating the aqueous phase from the triglyceride-containing composition;
d) bringing the triglyceride-containing composition from step c) into contact with at least one substance selected from organic acids, phosphoric acid, ethanolamine and solid adsorbents based on clay minerals, bleaching earths, aluminosilicates or silicates;
e) adding H2O to the composition according to step d);
f) separating the aqueous phase from the triglyceride-containing composition;

Using the method according to the invention, not only can the phosphorus content of crude vegetable oils and other triglyceride-containing compositions be reduced until it complies with the currently stipulated upper limit of 4 ppm in accordance with the EU standard EN 14214; but, using the method according to the invention, much lower residual levels of phosphorus can be achieved, with the result that even if the phosphorus content in biodiesel is cut further these values can still be complied with.

By the term "phosphorus-containing compound" is meant within the framework of this invention any compound that contains at least one phosphorus atom, in particular hydratable and non-hydratable phospholipids and phosphoglycosides.

By the term "triglyceride-containing composition" is meant within the framework of the present invention any composition that contains at least one triglyceride (according to IUPAC: triacylglycerol; the terms "triglyceride" and "triacylglycerol" are used synonymously within the framework of the present application), in particular biodiesel based on vegetable oil and its precursors.

The term "biodiesel precursor", as used within the framework of the present invention, denotes any mixtures that comprise mono- and/or diglycerides of fatty acids. For example, such mixtures may contain at least 30 wt.-%, preferably at least 60 wt.-%, preferably at least 85 wt.-%, in particular at least 90 wt.-% mono- or diglycerides, in each case relative to the total weight of the organic constituents of the mixture. Mixtures called "biodiesel precursors" can also optionally comprise fatty acid alkyl esters or fats. The term "fat" can, within the framework of the present invention, mean any mixture that comprises triglycerides. By fat is meant mixtures with a solid consistency, semisolid consistency or liquid consistency at room temperature. In common parlance, fats which are liquid at room temperature are often also called oils. It may be expressly pointed out that the term "fats" within the framework of the present invention also comprises any oils such as for example the fats which, according to general current language usage, are called soya oils, rape-seed oils, etc. below. A fat or a mixture of fats can be selected according to the general knowledge of a person skilled in the art. Fats of different origin and composition are for example listed in the "Lehrbuch der Lebensmittelchemie", Berlin, 2001, 5th edition, ISBN 3-540-41096-1, by Belitz, Grosch, Schieberle. It may be expressly mentioned, however, that fats which are contaminated or which occur as waste products, for example frying oils, also come into consideration as a fat. According to a preferred embodiment, the fat is a fat or oil with a lecithin content of less than 10 wt.-%, in particular less than 5 wt.-%, further preferably less than 10 ppm, in particular less than 5 ppm. According to an embodiment, degummed and/or deodorized fats or oils are also preferred, as well as biodiesel (precursors) with the above lecithin contents. A further preferred embodiment involves oils and/or fats which are regarded as difficult to degum as a result of a high level of non-hydratable phospholipids. By way of example, an oil may be specified which, after a predegumming with water, can still have a P content of up to 200 ppm.

The method according to the present invention is particularly preferably applied to triglyceride-containing compositions selected from the group consisting of soya oil, rape-seed oil, sunflower oil, linseed oil, jatropha oil, canola oil, cottonseed oil, pumpkin seed oil, coconut oil, rice germ oil, peanut oil, corn oil, olive kernel oil, jojoba oil, almond oil, palm oil and mixtures thereof. Further oils which can be used in the method of the present invention are oils which can be obtained from algae.

Likewise preferred is the use of triglyceride-containing compositions, in particular oils, as defined above which have already been subjected to a predegumming (for example using citric acid, phosphoric acid or water).

In particular, the method according to the invention is particularly suitable in general for triglyceride-containing compositions with a very high phosphorus content, in particular vegetable oils with a phosphorus content of more than 450 ppm, more than 550 ppm and more than 650 ppm. Even with these oils, a reduction of the phosphorus content to below the limit value according to EU standard EN 14214 is achieved by applying the method according to the invention.

By the term "bringing into contact" is meant any type of bringing into contact which is known by a person skilled in the art to be suitable for the purpose according to the invention. The triglyceride-containing composition is preferably mixed with the substance by stirring. In a preferred embodiment, the mixture is stirred for a period of from 1 minute to 24 hours, more preferably 5 minutes to 12 hours, further preferably from 15 minutes to 5 hours and most preferably from 30 minutes to 2 hours. The stirring preferably takes place in a water bath which is kept at a specific constant temperature. For details of the industrial implementation of a degumming process, reference may be made to "Practical Guide to Vegetable Oil Processing", Chapter 3-Crude Oil De-Gumming and Acid Pre-treatment, AOCS Press, p. 33 (2008).

The addition of H2O according to steps b) and e) can be carried out in any manner known by a person skilled in the art to be suitable for the purpose according to the invention. In a preferred embodiment, H2O in a quantity of from 0.1 to 15 wt.-% (relative to the quantity of trigylceride-containing composition), preferably from 0.5 to 10 wt.-%, further preferably from 1 to 7 wt.-% and most preferably from 2 to 5 wt.-% is added to the composition according to steps a) and d). In a preferred embodiment, the composition is stirred continuously during the addition. In a preferred embodiment, the added H2O remains in the composition for a period of from 1 minute to 12 hours, preferably from 5 minutes to 5 hours, further preferably from 10 minutes to 2 hours and most preferably from 30 minutes to 1 hour. In a particularly preferred embodiment, the composition is stirred continuously.

The separation of the aqueous phase from the composition according to steps c) and f) can be carried out in any manner known by a person skilled in the art to be suitable for the purpose according to the invention. The separation of the aqueous phase is preferably carried out by centrifuging preferably at 1000 to 5000 rpm, further preferably at 3000 to 4500 rpm and most preferably from 3500 to 4000 rpm, preferably for a period of from 1 minute to 30 minutes, further preferably from 5 minutes to 15 minutes.

In a particularly preferred embodiment, the bringing into contact according to steps a) and/or d) is carried out at a temperature of from 10 to 85° C., further preferably from 15 to 75° C., in particular preferably from 20 to 60° C., particularly preferably from 25 to 50° C. and most preferably from 35 to 45° C. In a further particularly preferred embodiment, the addition of H2O according to steps b) and/or e) is also carried out at a temperature of from 10 to 85° C., further preferably from 15 to 75° C., in particular preferably from 20 to 60° C., particularly preferably from 25 to 50° C. and most preferably from 35 to 45° C. In a likewise preferred embodiment, the method according to the present invention according to steps a) to f) is carried out at a temperature of from 10 to 85° C., further preferably from 15 to 75° C., in particular preferably from 20 to 60° C., particularly preferably from 25 to 50° C. and most preferably from 35 to 45° C.

The temperature control is preferably carried out here in a water bath. Likewise preferred is the addition according to steps b) and e) of H2O which has already been pre-heated to a temperature of from 10 to 85° C., further preferably from 15 to 75° C., in particular preferably from 20 to 60° C., particularly preferably from 25 to 50° C. and most preferably from 35 to 45° C. It is furthermore possible within the framework of the present invention for all of the steps a) to f) to be carried out at different temperatures.

In a further preferred embodiment of the present invention, the organic acid is selected from the group consisting of malic acid, tartaric acid, citric acid, lactic acid, formic acid, oxalic acid, malonic acid and mixtures thereof. Likewise preferred is the use of phosphoric acid and mixtures of all the above-named acids. Preferred concentrations of the organic and/or phosphoric acid are 0.01 to 5 wt.-% (relative to the weight of the triglyceride-containing composition), preferably 0.05 to 5 wt.-%, further preferably from 0.1 to 3 wt.-% and most preferably from 0.2 to 2 wt.-%.

In a further preferred embodiment of the present invention, the solid adsorbent is selected from the group consisting of aluminosilicates, aluminium oxides, hydrous aluminium oxides, silica gels, clay minerals, bleaching earths and mixtures thereof.

Within the framework of the method according to the invention adsorbents based on silica gels, such as are sold for example under the trade name Trisyl® by Grace in Worms, can be used for combining with the extracting agent. They can have a water content of up to 60%. The use and the production of such adsorbents are described in the patent specification EP 0185182 B1.

However, natural clay minerals can also be used as solid adsorbents. They can be attapulgites, sepiolites or smectic clays such as montmorillonites, beidellites, hectorites and saponites. In addition, kerolite-containing clays can also be used. If the clays listed above are used without additional treatment with acid only in a dried and ground state, they are often referred to as so-called natural clays. A specific case of such natural clays is represented by porous clays which consist of mixtures of smectic clays and silica gel. Such mixtures occur naturally and their use for the treatment of oil is described for example in the patent 'Surface-rich clays used for the production of bleaching earth, and method for the activation of said clays', WO 2006/131136, K. Schurz, Süd-Chemie AG.

However, the above clays for the treatment of oil are usually used in the form of so-called bleaching earths, i.e. these clays can be exposed to the action of acids, wherein reference is then made to a so-called 'Surface Modified Bleaching Earth' (SMBE). In addition, it is possible according to the state of the art to also boil such clays with acid and to produce, for example from montmorillonite, a highly activated bleaching earth. The production and use of such bleaching earths are described for example in the following citations: Practical Guide to Vegetable Oil Processing, M. K. Gupta, Chapter 5 Bleaching, p. 101, AOCS Press (2008); Bleaching of fats and oils, Introduction, W. Zschau, p. 505, European Journal of Lipid Science and Technology (2001); Bleaching of fats and oils, Chemical and physical basis of bleaching, W. Zschau, p. 509, European Journal of Lipid Science and Technology (2001); Was ist Bleicherde?, W. Zschau, p. 506, Fette Seifen Anstrichmittel (1985).

In the method according to the invention, aluminium-oxygen compounds such as hydrous aluminium oxide, boehmite and various aluminium oxides such as e.g. α-, β- and γ-aluminium oxide can also be used as adsorbents.

The composition comprises an aluminosilicate with a proportion by weight of $SiO_2$ of greater than 0.3, preferably greater than 0.35, particularly preferably greater than 0.4, relative to the sum of the proportions by weight of $SiO_2$ and $Al_2O_3$.

Moreover, the aluminosilicate preferably has an $SiO_2$ proportion by weight of less than 0.8, preferably less than 0.7, particularly preferably less than 0.65, relative to the sum of the proportions by weight of $SiO_2$ and $Al_2O_3$.

Within the meaning of the present invention, the aluminosilicate has a specific surface area of more than 350 $m^2/g$, preferably more than 400 $m^2/g$, particularly preferably of more than 450 $m^2/g$. Particularly preferred are aluminosilicates with a specific surface area of from 355 $m^2/g$ to 650 $m^2/g$, further preferably from 365 $m^2/g$ to 600 $m^2/g$, more preferably from 400 $m^2/g$ to 575 $m^2/g$, further preferably from 455 $m^2/g$ to 550 $m^2/g$. The specific surface area is determined according to the BET method.

According to a further preferred embodiment, the aluminosilicate preferably has a pore volume of from 0.5 ml/g to 1.4 ml/g, preferably a pore volume of from 0.55 ml/g to 1.3 ml/g, more preferably from 0.6 ml/g to 1.2 ml/g, particularly preferably from 0.6 ml/g to 0.99 ml/g, further particularly preferably from 0.6 ml/g to 0.95 ml/g and most preferably from 0.6 ml/g to 0.90 ml/g. The pore volume is determined as cumulative pore volume according to BJH (E. P. Barrett, L. G. Joyner, P. P. Halenda, J. Am. Chem. Soc. 73, 1951, 373) for pores with a diameter of from 1.7 to 300 nm.

The high specific surface area and the high pore volume on the one hand make possible in each case a high adsorption capacity for the impurities contained in the triglyceride-containing composition, such as for example phospholipids and metal ions, as well as rapid kinetics of the adsorption, with the result that the method is suitable in particular for an industrial application.

According to a preferred embodiment, the aluminosilicate comprises a proportion of further metals of less than 5 wt.-%, preferably less than 2 wt.-%, further preferably less than 1 wt.-%, in particular preferably less than 0.5 wt.-%. It is particularly preferred that the at least one aluminosilicate has a proportion of $Fe_2O_3$ of at most 0.2 wt.-%, more preferably of at most 0.1 wt.-%, further preferably of at most 0.05 wt.-% and most preferably of at most 0.02 wt.-%. It is further particularly preferred that the at least one aluminosilicate has a proportion of $Na_2O$ of at most 0.05 wt.-%, more preferably of at most 0.01 wt.-%, further preferably of at most 0.008 wt.-% and most preferably of at most 0.005 wt.-%.

Finally it is preferred that the aluminosilicate has a proportion of C of at most 0.5 wt.-%, more preferably of at most 0.4 wt.-%, further preferably of at most 0.3 wt.-% and most preferably of at most 0.2 wt.-%.

According to a further preferred embodiment, the aluminosilicate is a synthetic aluminosilicate.

Within the framework of the present invention it is possible for all of the preferred embodiments described in more detail above to also be combined with each other and it is likewise possible within the meaning of the present invention that if several aluminosilicates are contained in the aluminosilicate-containing composition they are of the same or of a different type and differ for example in their weight ratio of $SiO_2$:$Al_2O_3$, the specific surface area according to BET and/or the cumulative pore volume according to BJH and/or further parameters, provided at least one of the aluminosilicates contained has a proportion by weight of $SiO_2$ of greater than 0.3 relative to the sum of the proportions by weight of $SiO_2$ and $Al_2O_3$.

Particularly preferred aluminosilicate-containing compositions comprise at least one aluminosilicate with a proportion by weight of $SiO_2$ of greater than 0.3 relative to the sum of the proportions by weight of $SiO_2$ and $Al_2O_3$, a specific surface area according to BET of more than 350 $m^2/g$ and a cumulative pore volume according to BJH of more than 0.7 ml/g for pores between 1.7 and 300 nm, preferably greater than 0.8 ml/g, particularly preferably greater than 0.9 ml/g.

Particularly preferred aluminosilicate-containing compositions comprise at least one aluminosilicate with a proportion by weight of $SiO_2$ of greater than 0.3 relative to the sum of the proportions by weight of $SiO_2$ and $Al_2O_3$, a water content of from 5.0 to 8.0 wt.-%, a BET surface area of from 350 to 600 $m^2/g$, a cumulative pore volume according to BJH of from 0.6 to 1.0 $cm^3/g$ for pores with a diameter of from 1.7 to 300 nm and an average pore diameter of from 6.0 to 10.5 nm, as well as a C content of from 0.1 to 0.3 wt.-%, an $Fe_2O_3$ content of from 0.05 to 0.01 wt.-% and an $Na_2O$ content of from 0.01 to 0.001 wt.-%. Particularly preferred are aluminosilicate-containing compositions comprising at least one aluminosilicate with a proportion by weight of $SiO_2$ of greater than 0.3 relative to the sum of the proportions by weight of $SiO_2$ and $Al_2O_3$, a water content of from 6.0 to 8.0 wt.-%, a BET surface area of from 450 to 570 $m^2/g$, a cumulative pore volume according to BJH of from 0.75 to 0.95 $cm^3/g$ for pores with a diameter of from 1.7 to 300 nm and an average pore diameter of from 7.2 to 7.9 nm, as well as a C content of from 0.1 to 0.3 wt.-%, an $Fe_2O_3$ content of from 0.05 to 0.01 wt.-% and an $Na_2O$ content of from 0.01 to 0.001 wt.-%.

The aluminosilicate according to the present invention can be produced for example by hydrolyzing organic aluminium compounds under acid conditions and then aging them together with silicic acid or silicic acid compounds under hydrothermal conditions. Suitable aluminium compounds are for example aluminium alcoholates, aluminium hydroxyalcoholates, aluminium acetylacetonates, aluminium alkyl chlorides or also aluminium carboxylates. A suitable method is described for example in DE 03839580 and U.S. Pat. No. 6,245,310 B1. This method is particularly favourable because very high specific surface areas and porosities can thereby be achieved.

In order to obtain particularly pure aluminosilicates, hydrolyzable organosilicon compounds can also be used instead of silicic acid, wherein the hydrolysis of the organosilicon compounds and of the hydrolyzable aluminium compounds is carried out together. Such a method is described for example in EP 0 931 017 B1.

Aluminosilicates that contain only $SiO_2$ and $Al_2O_3$ as constituents are particularly preferably used. Those which have a weight ratio of $Al_2O_3$ to $SiO_2$ of at least 0.3 and at most 0.7, preferably at least 0.35 and at most 0.65 are preferred. The proportion of further metals, calculated as the most stable oxide, is preferably selected to be less than 5 wt.-%, further preferably less than 3 wt.-%, particularly preferably less than 2 wt.-% and most preferably less than 1 wt.-%.

Any mixtures of the adsorbents listed above can also be used as adsorbents which are used according to the method according to the invention in combination with the complexing agents.

The adsorbents used within the framework of the invention can be provided for example in the form of a powder. A composition in the form of a powder is suitable for example if the adsorbent is stirred into the vegetable oil, i.e. is present in the form of a suspension.

The particle size of the powder is set within the meaning of the invention such that the adsorbent can be separated from the purified vegetable oil without difficulty with a suitable method, such as for example filtration, within a suitable period of time. If a powder suspended in the crude vegetable oil is used, the dry sieve residue of the adsorbent on a sieve with a mesh size of 63 μm is preferably more than 25 wt.-% and lies preferably in a range of from 30 to 50 wt.-%. The dry sieve residue on a sieve with a mesh size of 25 μm is preferably more than 80 wt.-% and lies preferably in a range of from 85 to 88 wt.-%. Furthermore the dry sieve residue on a sieve with a mesh size of 45 μm is preferably more than 35 wt.-%, particularly preferably more than 45 wt.-%.

However, higher particle sizes are also suitable in particular for an application of the adsorbent in the form of a column packing. For this, the adsorbent is preferably used in the form of a granular material. Preferably a granular material which has a particle size of more than 0.1 mm is used for the production of column packings. Preferably the granular material has a particle size in the range of from 0.2 to 5 mm, in particular preferably 0.3 to 2 mm. The particle size can be set for example by sieving.

The granular material can be produced according to customary methods by for example exposing the finely-ground adsorbent to the action of a granulating agent, for example water, and then granulating it a customary granulation device in a mechanically produced fluidized bed. However, other methods can also be used to produce the granular material. Thus the powdery adsorbent can for example be shaped into a granular material by compacting.

Preferred concentrations of the adsorbent are 0.05 to 6 wt.-% (relative to the weight of the triglyceride-containing composition), preferably 0.1 to 5 wt.-%, further preferably from 0.15 to 3 wt.-% and most preferably from 0.2 to 2 wt.-%.

In a further preferred embodiment of the present invention, ethanolamine is selected from the group consisting of monoethanolamine, diethanolamine, triethanolamine and mixtures thereof, wherein monoethanolamine is particularly preferred. Preferred concentrations of the ethanolamine are 0.001 to 5 wt.-% (relative to the weight of the triglyceride-containing composition), preferably 0.005 to 5 wt.-%, further preferably from 0.01 to 3 wt.-% and most preferably from 0.1 to 2 wt.-%.

In a further preferred embodiment of the method according to the invention, step a) and/or d) is carried out at atmospheric pressure or under vacuum. It is likewise preferred that step b) and/or e) is carried out at atmospheric pressure or under vacuum. Finally, it is possible for all of the steps a) to f) to be carried out at atmospheric pressure or under vacuum.

It is furthermore possible within the framework of the present invention to repeat steps d) to f), i.e. to carry out a renewed bringing of the triglyceride-containing composition into contact with at least one substance selected from organic acids, phosphoric acid, ethanolamine and solid adsorbents based on clay minerals, bleaching earths, aluminosilicates or silicates or mixtures thereof, as well as the subsequent addition of H2O to the composition followed by a separation of the aqueous phase from the triglyceride-containing composition.

Within the framework of the present invention, all of the embodiments as they are described here can be freely combined with each other. Particularly preferred embodiments according to the present invention are for example:

A) a method for removing phosphorus-containing compounds from triglyceride-containing compositions comprising the following steps:
   a) bringing the triglyceride-containing composition into contact with at least one ethanolamine, preferably monoethanolamine;
   b) adding H2O to the composition according to step a);
   c) separating the aqueous phase from the triglyceride-containing composition;
   d) bringing the triglyceride-containing composition from step c) into contact with at least one organic acid, preferably citric acid;
   e) adding H2O to the composition according to step d);
   f) separating the aqueous phase from the triglyceride-containing composition.

It is furthermore particularly preferred if the method is carried out at a temperature of from 35 to 45° C., preferably at 40° C. It is furthermore preferred if the organic acid is used in a concentration of from 0.1 to 0.5 wt.-%, preferably 0.2 wt.-%, and particularly preferably a 20% citric acid is involved. It is likewise preferred if the ethanolamine is added in the form of monoethanolamine, preferably in a concentration of from 0.1 to 1 wt.-%, particularly preferably 0.5 wt.-%.

B) a method for removing phosphorus-containing compounds from triglyceride-containing compositions comprising the following steps:
   a) bringing the triglyceride-containing composition from step c) into contact with at least one organic acid, preferably citric acid;
   b) adding H2O to the composition according to step a);
   c) separating the aqueous phase from the triglyceride-containing composition;
   d) bringing the triglyceride-containing composition into contact with at least one ethanolamine, preferably monoethanolamine;
   e) adding H2O to the composition according to step d);
   f) separating the aqueous phase from the triglyceride-containing composition.

It is furthermore particularly preferred if the method is carried out at a temperature of from 35 to 45° C., preferably at 40° C. It is furthermore preferred if the organic acid is used in an absolute concentration of from 0.1 to 2 wt.-%, preferably 1 wt.-%, and a 50% citric acid solution is particularly preferably used here. It is likewise preferred if the ethanolamine is added in the form of monoethanolamine, preferably in a concentration of from 0.1 to 1 wt.-%, particularly preferably 0.5 wt.-%.

C) a method for removing phosphorus-containing compounds from triglyceride-containing compositions comprising the following steps:
   a) bringing the triglyceride-containing composition into contact with at least one ethanolamine, preferably monoethanolamine;
   b) adding H2O to the composition according to step a);
   c) separating the aqueous phase from the triglyceride-containing composition;
   d) bringing the triglyceride-containing composition from step c) into contact with at least one adsorbent, preferably an aluminosilicate;
   e) adding H2O to the composition according to step d);
   f) separating the aqueous phase from the triglyceride-containing composition.

It is furthermore particularly preferred if the method is carried out at a temperature of from 35 to 45° C., preferably at 40° C. It is moreover preferred if the ethanolamine is added in the form of monoethanolamine, preferably in a concentration of from 0.1 to 1 wt.-%, particularly preferably 0.5 wt.-%. It is likewise preferred if the adsorbent is added in a concentration of from 0.1 to 2 wt.-%, preferably 1 wt.-%.

D) a method for removing phosphorus-containing compounds from triglyceride-containing compositions comprising the following steps:

a) bringing the triglyceride-containing composition from step c) into contact with at least one adsorbent, preferably an aluminosilicate;

b) adding H2O to the composition according to step a);

c) separating the aqueous phase from the triglyceride-containing composition;

d) bringing the triglyceride-containing composition according to step c) into contact with at least one ethanolamine, preferably monoethanolamine;

e) adding H2O to the composition according to step d);

f) separating the aqueous phase from the triglyceride-containing composition.

It is furthermore particularly preferred if the method is carried out at a temperature of from 35 to 45° C., preferably at 40° C. It is moreover preferred if the ethanolamine is added in the form of monoethanolamine, preferably in a concentration of from 0.1 to 1 wt.-%, particularly preferably 0.5 wt.-%. It is likewise preferred if the adsorbent is added in a concentration of from 0.1 to 2 wt.-%, preferably 1 wt.-%.

Measurement Methods and Processes

Predegumming a) Predegumming with Water

The crude oil is heated to 40° C. accompanied by stirring. While maintaining this temperature, 5% (w/w) dist. water, calculated on the basis of the quantity of crude oil, is added dropwise and the reaction mixture stirred for 1 h. The precipitate formed is then centrifuged at room temperature at 4000 rpm for a period of 15 min. The remaining oil is the oil predegummed with water for the subsequent tests.

b) Predegumming with Citric Acid

The crude oil is heated to 40° C. accompanied by stirring. While maintaining this temperature, 5% (w/w) of a 10% aqueous citric acid solution, calculated on the basis of the quantity of crude oil, is added dropwise and the reaction mixture stirred for 1 h. The precipitate formed is then centrifuged at room temperature at 4000 rpm for a period of 15 min. The remaining oil is the oil predegummed with citric acid for the subsequent tests.

Degumming with Organic Acids, Phosphoric Acid, Solid Adsorbent or Ethanolamine

1st Degumming Stage 20 g of the predegummed oil (predegumming a or b) in a small beaker has the corresponding quantity of organic acid, phosphoric acid, solid adsorbent or ethanolamine added to it. The mixture is stirred in a 40° C. temperature-controlled water bath. After 60 min, 2% dist. water (relative to the quantity of predegummed oil used) is added dropwise to this mixture and the whole mixture stirred for a further 30 min in a water bath at 40° C. The oil is then separated from the precipitate and the water phase by centrifuging at 4000 rpm for a period of 15 min. The thus-purified oil is subjected to the metal and P analysis or can be subjected to a second degumming stage.

2nd Degumming Stage

The oil obtained from the first degumming stage is used again and subjected to a procedure analogous to the first stage.

Methods

The physical properties of the adsorbents were determined using the following methods:

BET surface area/pore volume according to BJH and BET:

The surface area and the pore volume were determined with a fully automatic Micromeritics ASAP 2010 type nitrogen porosimeter.

The sample is cooled in high vacuum to the temperature of liquid nitrogen. Nitrogen is then continuously dispensed into the sample chambers. An adsorption isotherm is calculated at constant temperature by ascertaining the adsorbed quantity of gas as a function of the pressure. The analysis gas is progressively removed and a desorption isotherm recorded in a pressure equalization.

To calculate the specific surface area and the porosity according to the BET theory, the data are evaluated according to DIN 66131.

The pore volume is furthermore calculated from the measurement data applying the BJH method (E. P. Barrett, L. G. Joyner, P. P. Halenda, J. Am. Chem. Soc. 73, 1951, 373). Capillary condensation effects are also taken into account with this method. Pore volumes of specific volume size ranges are determined by totalling incremental pore volumes obtained from the evaluation of the adsorption isotherm according to BJH. The total pore volume according to the BJH method relates to pores with a diameter of from 1.7 to 300 nm.

Water Content:

The water content of the products at 105° C. is calculated using the DIN/ISO-787/2 method.

Loss on Ignition:

In an annealed weighed porcelain crucible with a lid, approx. 1 g of dried sample is weighed in accurate to within 0.1 mg and annealed for 2 h at 1000° C. in the muffle furnace. The crucible is then cooled in the desiccator and weighed out.

Determining the Dry Sieve Residue

Approximately 50 g of the air-dry clay material to be examined is weighed in on a sieve of the appropriate mesh size. The sieve is connected to a vacuum cleaner which sucks out through the sieve via a suction slit rotating beneath the sieve bottom all of the portions which are finer than the sieve. The sieve is covered with a plastic lid and the vacuum cleaner is switched on. After 5 minutes, the vacuum cleaner is switched off and the quantity of coarser portions remaining on the sieve is calculated by differential weighing.

Determining the Bulk Density

A measuring cylinder cut off at the 100-ml mark is weighed. The sample to be examined is then poured in one go into the measuring cylinder by means of a powder funnel such that a bulk mass forms above the top of the measuring cylinder. The bulk mass is wiped off with the help of a ruler which is passed across the opening of the measuring cylinder, and the filled measuring cylinder is weighed again. The difference corresponds to the bulk density.

Description of the Adsorbents

The following tables list the chemical compositions and physical properties of the adsorbents that are used in the following examples. Trisyl® 300 is a commercially available silica gel from Grace in Worms.

TABLE 1a

Chemical composition of the adsorbents

| Adsorbent | Aluminosilicate 1 |
|---|---|
| $Al_2O_3 + SiO_2$ content (wt.-%) | 75 |
| LOI (wt.-%) | 25 |
| $Al_2O_3$:$SiO_2$ (wt.-%) | 60:40 |
| C (wt.-%) | 0.2 |
| $Fe_2O_3$ (wt.-%) | 0.02 |
| $Na_2O$ (wt.-%) | 0.005 |

TABLE 1a-continued

| Chemical composition of the adsorbents | |
|---|---|
| Adsorbent | Bleaching earth 1 |
| $SiO_2$ (%) | 70.1 |
| $Al_2O_3$ (%) | 10.0 |
| $Fe_2O_3$ (%) | 3.0 |
| CaO (%) | 1.5 |
| MgO (%) | 4.3 |
| $Na_2O$ (%) | 0.3 |
| $K_2O$ (%) | 1.4 |
| Loss on ignition (%) | 8.6 |

TABLE 1b

| Physical properties of the adsorbents | | | |
|---|---|---|---|
| Adsorbent | Bleaching earth 1 | Alumino-silicate 1 | Trisyl ® 300 |
| Bulk density (g/l) | 350 | 250-450 | 354 |
| Average particle size (d50) [μm] | n.d. | 50 | 15 |
| Dry sieve residue on 45 μm (%) | 49 | n.d. | n.d. |
| Dry sieve residue on 63 μm (%) | 35 | n.d. | n.d. |
| Water content (wt.-%) | max. 15 | 7.8 | 57 |
| BET surface area ($m^2/g$) | 225 | 512 | 669 |
| Cumulative pore volume (BJH) for pore diameters 1.7-300 nm ($cm^3/g$) | 0.825 | 0.97 | n.d. |
| Average pore diameter (BJH) (nm) | 16.4 | 7.2 | n.d. |

EXAMPLES AND FIGURES

It is pointed out that the examples and figures listed below are purely illustrative and serve merely to clarify the method according to the invention, but in no way limit the present invention.

There are shown in:

FIG. 1: The concentrations of Ca, Mg and P after carrying out the method according to the invention according to Example 1 based on predegummed soya oil (predegumming with water and citric acid)

Figure 2:
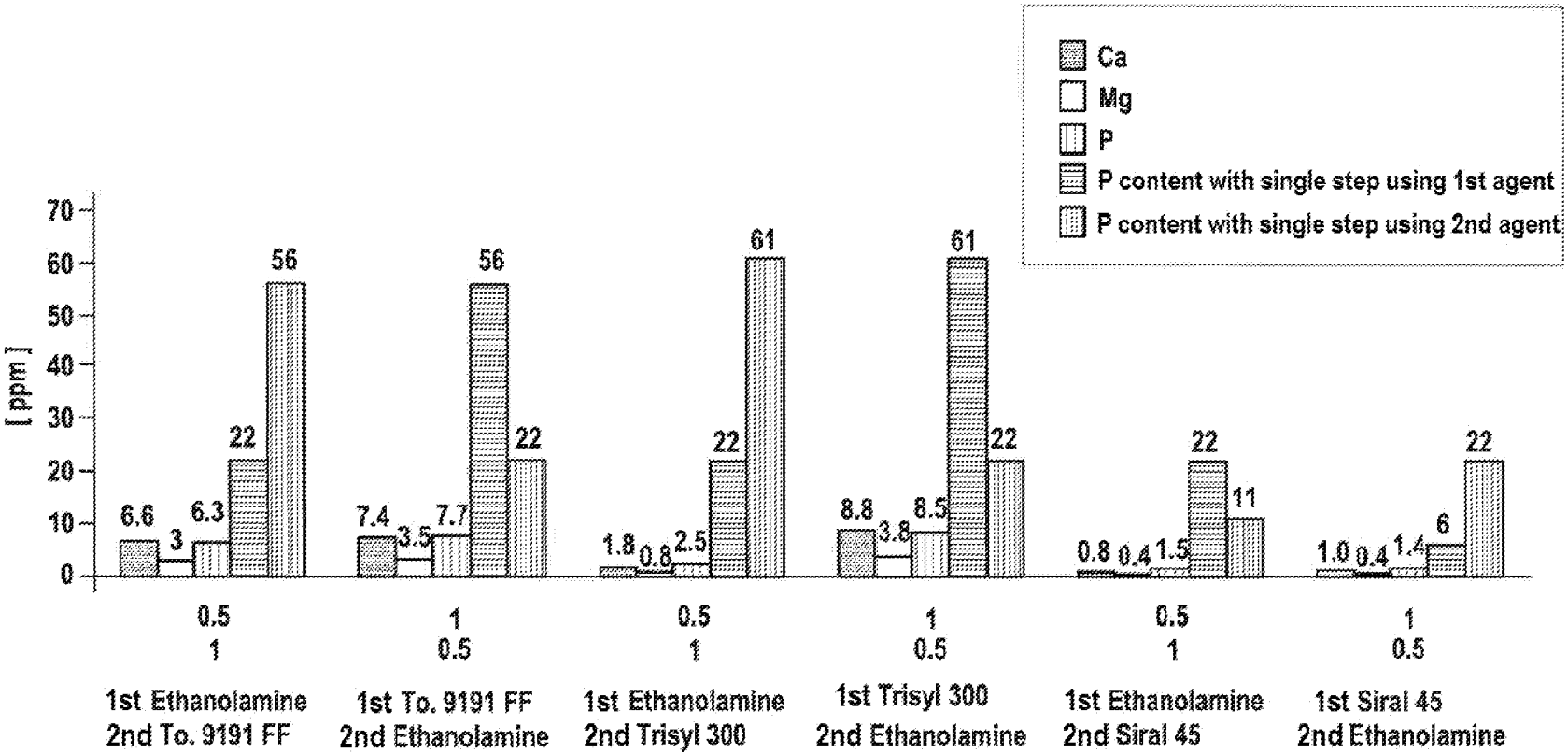

FIG. 2: The concentrations of Ca, Mg and P after carrying out the method according to the invention according to Example 2 based on predegummed soya oil (predegumming with water) as well as after carrying out only one treatment step in each case (here only P content)

EXAMPLE 1

Comparison of the final Ca, Mg and P contents in the case of predegumming with water or citric acid as well as a different sequence in the subsequent treatment with citric acid and ethanolamine.

EXAMPLE 1.1

A crude soya oil is predegummed with water. This predegummed oil (SO 1.1a) is treated with 0.5% ethanolamine (SO 1.1b).

treated with 0.5% ethanolamine in the first stage (corresponds to step a) of the method according to the invention) and treated with 2% aqueous citric acid (50%) in the second stage (corresponds to step b) of the method according to the invention) (SO 1.1c).

treated with 2% aqueous citric acid (50%) in the first stage and treated with 0.5% ethanolamine in the second stage (SO 1.1d).

treated with 2% aqueous citric acid (50%) (SO 1.1e).

EXAMPLE 1.2

The crude soya oil from Example 1.1a is predegummed with citric acid (SO 1.2a). This predegummed oil is treated with 0.5% ethanolamine (SO 1.2b) or with 2% of a 50% citric acid (SO 1.2c)

Results for Example 1

TABLE 1

| | Predegumming with water | | | | | Predegumming with citric acid | | |
|---|---|---|---|---|---|---|---|---|
| Example | SO 1.1a | SO 1.1b | SO 1.1c | SO 1.1d | SO 1.1e | SO 1.2a | SO 1.2b | SO 1.2c |
| [ppm] | — | 0.5% ethanol-amine | 1st 0.5% ethanolamine 2nd H3Cit | 1st 2% H3Cit 2nd 0.5% ethanolamine | 2% H3Cit (50%) | — | 0.5% ethanol-amine | 2% H3Cit (50%) |
| Ca | 49 | 18 | 0.8 | 0.45 | 4.0 | 19 | 3 | 1 |
| Mg | 31 | 11 | 0.4 | <0.1 | 3.3 | 13 | 0.8 | 1.4 |
| P | 108 | 22 | 8.0 | 1.3 | 16.5 | 55 | 2.7 | 16 |

These results show that a combination of ethanolamine with citric acid affords a clear improvement in the results. Ethanolamine can be used in a very small proportion. A degumming solely with citric acid or solely with ethanolamine is not sufficient.

EXAMPLE 2

Combination of Ethanolamine with Adsorbents

EXAMPLE 2.1

A crude soya oil is predegummed with water. This predegummed oil is treated with 0.5% ethanolamine as a first stage. The oil obtained herefrom is further treated in a second stage with 1% adsorbent. A bleaching earth, an aluminosilicate as well as a silica gel are used as adsorbents (cf. description of the adsorbents). The silica gel is the product Trisyl® 300 from Grace, Worms.

EXAMPLE 2.2

The test is carried out analogously to Example 2.1, but the sequence of the degumming steps is changed, i.e. first stage 1% adsorbent, second stage 0.5% ethanolamine.

TABLE 2

| | | [ppm] | | | | |
|---|---|---|---|---|---|---|
| Adsorbent | Proportion % | Ca | Mg | P | P content with single step using 1st agent | P content with single step using 2nd agent |
| 1st Ethanolamine | 0.5 | 6.6 | 3 | 6.3 | 22 | 56 |
| 2nd Bleaching earth 1 | 1 | | | | | |
| 1st Bleaching earth 1 | 1 | 7.4 | 3.5 | 7.7 | 56 | 22 |
| 2nd Ethanolamine | 0.5 | | | | | |
| 1st Ethanolamine | 0.5 | 1.8 | 0.8 | 2.5 | 22 | 61 |
| 2nd Trisyl ® 300 | 1 | | | | | |
| 1st Trisyl ® 300 | 1 | 8.8 | 3.8 | 8.5 | 61 | 22 |
| 2nd Ethanolamine | 0.5 | | | | | |
| 1st Ethanolamine | 0.5 | 0.8 | 0.4 | 1.5 | 22 | 11 |
| 2nd Alumino-silicate 1 | 1 | | | | | |
| 1st Alumino-silicate 1 | 1 | 1.0 | 0.4 | 1.4 | 6 | 22 |
| 2nd Ethanolamine | 0.5 | | | | | |

A combination of aluminosilicate 1 with ethanolamine almost completely removes Ca, Mg and P, whereas when they are used singly the final P content is significantly higher. Although an additional step is hereby carried out, it can significantly reduce the proportions used. This is also shown in the combination of ethanolamine with other adsorbents. If ethanolamine is used in the first step, the final results are even more advantageous.

For comparison: The soya oil is treated in the customary manner, i.e. for example a predegumming with 10% water at 80° C. for 20 min, after separation of the oil phase an addition of 0.2% of a 20% citric acid and reaction time of 20 min at 80° C. In this batch the customary adsorbent (e.g. bleaching earth 1, Trisyl® 300) is added and treated at 110° C. for 30 min and 30 mbar. Even when an adsorbent proportion of 2% was used, a P content of 38 ppm, Ca content of 18 ppm and Mg content of 12 ppm for Trisyl® 300 and 66 ppm (P), 34 ppm (Ca), 23 ppm (Mg) for bleaching earth 1 was still obtained here. The required specification of less than 4 ppm P and less than 10 ppm Ca and Mg were not able to be achieved in this manner.

In contrast, with the method according to the invention these values can be achieved with significantly lower proportions of adsorbents and complexing agents.

The invention claimed is:

1. A method for removing phosphorus-containing compounds from triglyceride-containing compositions comprising the following steps:

a) bringing the triglyceride-containing composition into contact with at least one substance selected from organic acids, phosphoric acid, ethanolamines and solid adsorbents based on clay minerals, bleaching earths, aluminosilicates, silica gels, precipitated silicas and silicates;

b) adding H2O to the composition obtained according to step a);

c) separating the aqueous phase from the triglyceride-containing composition;

d) bringing the triglyceride-containing composition obtained from step c) into contact with at least one substance selected from organic acids, phosphoric acid, ethanolamine and solid adsorbents based on clay minerals, bleaching earths, aluminosilicates, silica gels, precipitated silicas and silicates;

wherein i) step a) comprises bringing the triglyceride-containing composition into contact with at least one ethanolamine and step d) comprises bringing the triglyceride-containing composition into contact with at least an organic acid or at least one adsorbent, or ii) step a) comprises bringing the triglyceride-containing composition into contact with at least one organic acid or at least one adsorbent and in step d) comprises bringing the triglyceride-containing composition into contact with at least one ethanolamine;

e) adding H2O to the composition obtained according to step d);

f) separating the aqueous phase from the triglyceride-containing composition.

2. The method according to claim 1, wherein step a) and/or d) is carried out at a temperature of from 20 to 60° C.

3. The method according to claim 2, wherein step a) and/or d) is carried out at a temperature of from 25 to 50° C.

4. The method according claim 1, wherein the triglyceride-containing composition comprises soya oil, rape-seed oil, sunflower oil, palm oil, jatropha oil, linseed oil, canola oil, cotton-seed oil, pumpkin seed oil, coconut oil, rice germ oil, peanut oil, corn oil, olive kernel oil, jojoba oil, almond oil and/or *algae* oil.

5. The method according to claim 1, wherein the organic acid is selected from the group consisting of malic acid, tartaric acid, citric acid, lactic acid, formic acid, oxalic acid, malonic acid and mixtures thereof.

6. The method according to claim 1, wherein the solid adsorbent is selected from the group consisting of aluminosilicates, aluminium oxides, hydrous aluminium oxides, silica gel-based compositions, bleaching earths and mixtures thereof.

7. The method according to claim 1, wherein the ethanolamine is selected from the group consisting of monoethanolamine, diethanolamine, triethanolamine and mixtures thereof.

8. The method according to claim 1, wherein the concentration of the organic acid is in the range of from 0.01 to 5 wt.-% (relative to the weight of the triglyceride-containing composition).

9. The method according to claim 1, wherein the concentration of the adsorbent is in the range of from 0.1 to 5 wt.-% (relative to the weight of the triglyceride-containing composition).

10. The method according to claim 1, wherein the concentration of the ethanolamine is in the range of from 0.01 to 3.0 wt.-% (relative to the weight of the triglyceride-containing composition).

11. The method according to claim 1, wherein step a) and/or d) is carried out at atmospheric pressure or under vacuum.

12. The method according to claim 1, wherein the triglyceride-containing composition is brought into contact according to step a) with ethanolamine.

13. The method according to claim 1, wherein the triglyceride-containing composition is brought into contact according to step d) with an organic acid, or a solid adsorbent.

* * * * *

UNITED STATES PATENT AND TRADEMARK OFFICE

CERTIFICATE OF CORRECTION

PATENT NO. : 8,987,487 B2
APPLICATION NO. : 13/879168
DATED : March 24, 2015
INVENTOR(S) : Ulrich Sohling, Friedrich Ruf and Andrea Stege It is certified that error appears in the above-identified patent and that said Letters Patent is hereby corrected as shown below:

On the Title Page, References cited

Page 2, Other Publications:

"BARRETT, J. AM. CHEM. SOC., VOL. 736, PG. 373-380, JANUARY 1951"

should be

-BARRETT, J. AM. CHEM. SOC., VOL. 73, PG. 373-380, JANUARY 1951-

Page 2, Other Publications:

"ZSCHAU, EUR JOURNAL LIPID SCI. TECHNOL. VOL. 102, P. 505-508, 2001"

should be

-ZSCHAU, EUR JOURNAL LIPID SCI. TECHNOL. VOL. 103, P. 505-508, 2001-

Signed and Sealed this
Fifteenth Day of September, 2015

Michelle K. Lee

Michelle K. Lee
*Director of the United States Patent and Trademark Office*